US006840779B2

(12) United States Patent
Eberle et al.

(10) Patent No.: US 6,840,779 B2
(45) Date of Patent: Jan. 11, 2005

(54) HIGH POWER DATA LINE CONNECTION

(75) Inventors: Andreas Eberle, Balzers (LI); Franz Neff, Balzers (LI); Herbert Dauba, Gräfelfing (DE)

(73) Assignee: Setec Netzwerke AG, Schaan (LI)

( * ) Notice: Subject to any disclaimer, the term of this patent is extended or adjusted under 35 U.S.C. 154(b) by 0 days.

(21) Appl. No.: 10/833,723

(22) Filed: Apr. 28, 2004

(65) Prior Publication Data

US 2004/0203292 A1 Oct. 14, 2004

Related U.S. Application Data

(63) Continuation of application No. PCT/EP02/11842, filed on Oct. 23, 2002.

(30) Foreign Application Priority Data

Oct. 29, 2001 (EP) ..... 01125756

(51) Int. Cl.[7] ..... H01R 12/00
(52) U.S. Cl. ..... 439/76.1; 439/941; 439/326
(58) Field of Search ..... 439/76, 676, 941, 439/326, 76.1

(56) References Cited

U.S. PATENT DOCUMENTS 5,069,641 A * 12/1991 Sakamoto et al. ..... 439/620
5,350,317 A * 9/1994 Weaver et al. ..... 439/500
5,687,233 A 11/1997 Loudermilk et al.
5,797,764 A * 8/1998 Coulombe et al. ..... 439/55
6,120,329 A 9/2000 Steinman
6,179,650 B1 1/2001 Chih-Kai
6,190,211 B1 2/2001 Chu
6,302,741 B1 10/2001 Fasold et al.

FOREIGN PATENT DOCUMENTS

| | | |
|---|---|---|
| DE | 197 32 297 A1 | 4/1998 |
| DE | 201 03 505 U | 2/2001 |
| EP | 0 955 703 A2 | 11/1999 |
| EP | 0 997 989 A2 | 5/2000 |
| EP | 1 089 536 A1 | 4/2001 |
| GB | 2 344 470 A | 6/2000 |

* cited by examiner

*Primary Examiner*—Tho D. Ta
*Assistant Examiner*—James R. Harvey
(74) *Attorney, Agent, or Firm*—Alston & Bird LLP

(57) ABSTRACT

A data line connection which comprises a base printed circuit board, a female connector mounted to the base printed circuit board, and a compensation printed circuit board mounted within the female connector. The compensation printed circuit board mounts a plurality of electrically conductive contact elements as well as a compensation circuit for reducing electrical interference. The base printed circuit board includes a further compensation circuit for further reducing electrical interference.

9 Claims, 6 Drawing Sheets

HIGH POWER DATA LINE CONNECTION

CROSS REFERENCE TO RELATED APPLICATION

The present application is a continuation of international application PCT/EP02/11842, filed 23 Oct. 2002, and which designates the U.S. The disclosure of the referenced application is incorporated herein by reference.

BACKGROUND OF THE INVENTION

The invention relates to a female connector and connecting socket for producing a high-power data line connection to such a female connector.

In order to produce a data line connection from a server to a terminal (channel) or between the corresponding connecting socket (link) with a high data transmission capacity, all the components of the channel or link, in particular the data cables and connecting sockets, have to satisfy specific minimum requirements relating to their transmission characteristics. The components are subdivided on the basis of their transmission characteristics into various categories of which, at the moment, categories 5, 5*e* and 6 are of particular interest. It is planned to standardize the specifications for components in the relevant categories. On the basis of a standardization proposal such as this, cables in categories 5, 5*e* and 6 have to suppress the near end crosstalk or NEXT by 32.3, 35.3 or 44.3 dB at 100 MHz. For connecting sockets of categories 5, 5*e* and 6, values of 40, 43 and 54 dB apply for NEXT losses at 100 MHz. The requirements for classes 5, 5*e* and 6 can be satisfied relatively well at the moment for cables, but no satisfactory solution exists for connecting sockets, particularly those in category 6.

Connecting sockets normally have at least one female connector, for example an RJ45 female connector, with a holding element for the plug of a data cable and two or more elongated contact elements, which are bent in a hook shape, extend over the majority of the length of the holding element and, during use, make contact with the lines of the data cable, or the corresponding contact elements on the plug. The female connector is mounted on a base printed circuit board, which contains line connections to a connecting strip for a further data cable, which is generally stationary. One end of the hook-shaped contact elements of the female connector is in each case passed out of the holding element and is soldered directly to the base printed circuit board, or to a line connection on it. In known designs, the electrically conductive components are located in the immediate physical vicinity of one another without any screening, and interfere with one another. RJ45 female connectors have 8 contact elements which are located alongside one another, for the 4 pairs of lines in the corresponding data cables. One line pair is in each case associated with the contact elements 1/2, 4/5 and 7/8, while a further line pair is connected to the contact elements 3 and 6. Because of this physical arrangement, the interference between the pairs 3/6 and 4/5 is particularly severe.

In order to reduce interference, it is known for the base printed circuit board to be equipped with a compensation circuit which decouples individual lines or line pairs from one another, for example capacitively. Connecting sockets with such compensation circuits generally comply with the category 5 or 5*e* requirements. However, an improvement by 11 dB at 100 MHz is required for the jump to category 6, and this has not yet been achieved with the described design.

A female connector with a holding element and a printed circuit board integrated in it is known from U.S. Pat. No. 6,190,211. A compensation circuit is located on the printed circuit board, in order to reduce interference.

The invention is thus based on the object of providing a female connector and a connecting socket with improved transmission characteristics. The female connector should preferably have the same geometry as female connectors that are already in use, in particular in accordance with RJ45, in order to be compatible with conventional standard plugs.

SUMMARY OF THE INVENTION

The above and over objects and advantages of the invention are achieved by the provision of a data line connection which comprises a base printed circuit board, a female connector mounted to the base printed circuit board, and a compensation printed circuit board mounted within the female connector. The compensation printed circuit board mounts a plurality of electrically conductive contact elements as well as a compensation circuit for reducing electrical interference. The base printed circuit board includes a further compensation circuit for further reducing electrical interference.

The invention is based on the surprising discovery that even structures of less than 1/10 of the wavelength of the relevant signals have an influence on the mutual interference. Moving the compensation circuit from the base printed circuit board into the immediate physical vicinity of the contact elements of the female connector leads to considerably better compensation, in particular for the NEXT values. This effect is reinforced by shortening the length of the contact elements or of the signal paths from the contact elements of the plug to the compensation circuit, or to the connections of a further cable. The signals are provided with compensation before they leave the female connector, and the signals can be further corrected in a less complex manner, on the base printed circuit board.

According to the invention, the contact elements of a female connector are attached to a compensation printed circuit board, which contains a compensation circuit in order to reduce interference influences, in particular crosstalk influences, between lines, and which is arranged within the holding element for the plug. The contact elements in the female connector may be very short since they extend only from the contact elements of the plug to the compensation printed circuit board, and need not be passed out of the female connector or holding element, as in the case of the prior art. The strength of the mutual interference between the signal paths, in particular the mutual crosstalk, is reduced. Finally, the compensation circuit on the compensation printed circuit board may be simplified, for example by using capacitors with smaller capacitances.

The compensation printed circuit board may be integrated in any desired female connectors whose holding element is particularly matched to plugs with a form that is known per se. This avoids compatibility problems when changing to category 6 components. Holding elements and female connectors which correspond to the RJ45 shape are preferably used. The compensation printed circuit board extends, for example, over the bottom surface of the holding element or forms the bottom surface, and is removable. Mounting elements are preferably provided for mounting on the base printed circuit board, and, in a particularly preferably form, they allow mounting in various positions relative to it.

In addition to at least one female connector according to the invention, the connecting socket has a base printed circuit board and a connecting strip. Further elements may also be provided, for example in order to form a preferably screened housing. The housing may be designed in a known manner, for example according to EP-A 0928052.

BRIEF DESCRIPTION OF THE DRAWINGS

Exemplary embodiments of the invention will be described in the following text and are illustrated in the drawings in which, purely schematically

DETAILED DESCRIPTION OF THE PREFERRED EMBODIMENTS

Figure 1:
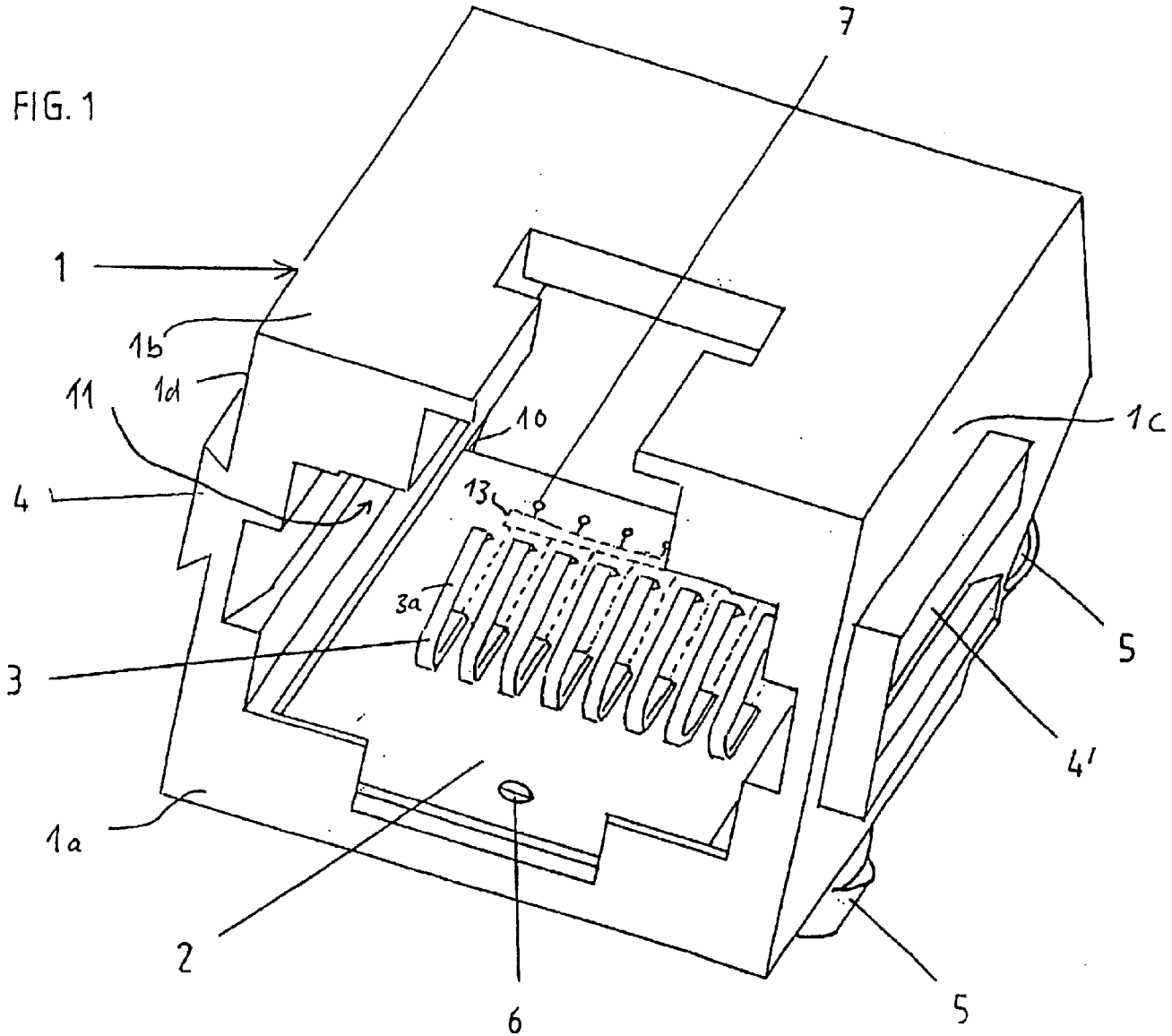
FIGS. 1 and 2 show a female connector according to the invention in a view obliquely from the front and from the rear, respectively.
Figure 2:
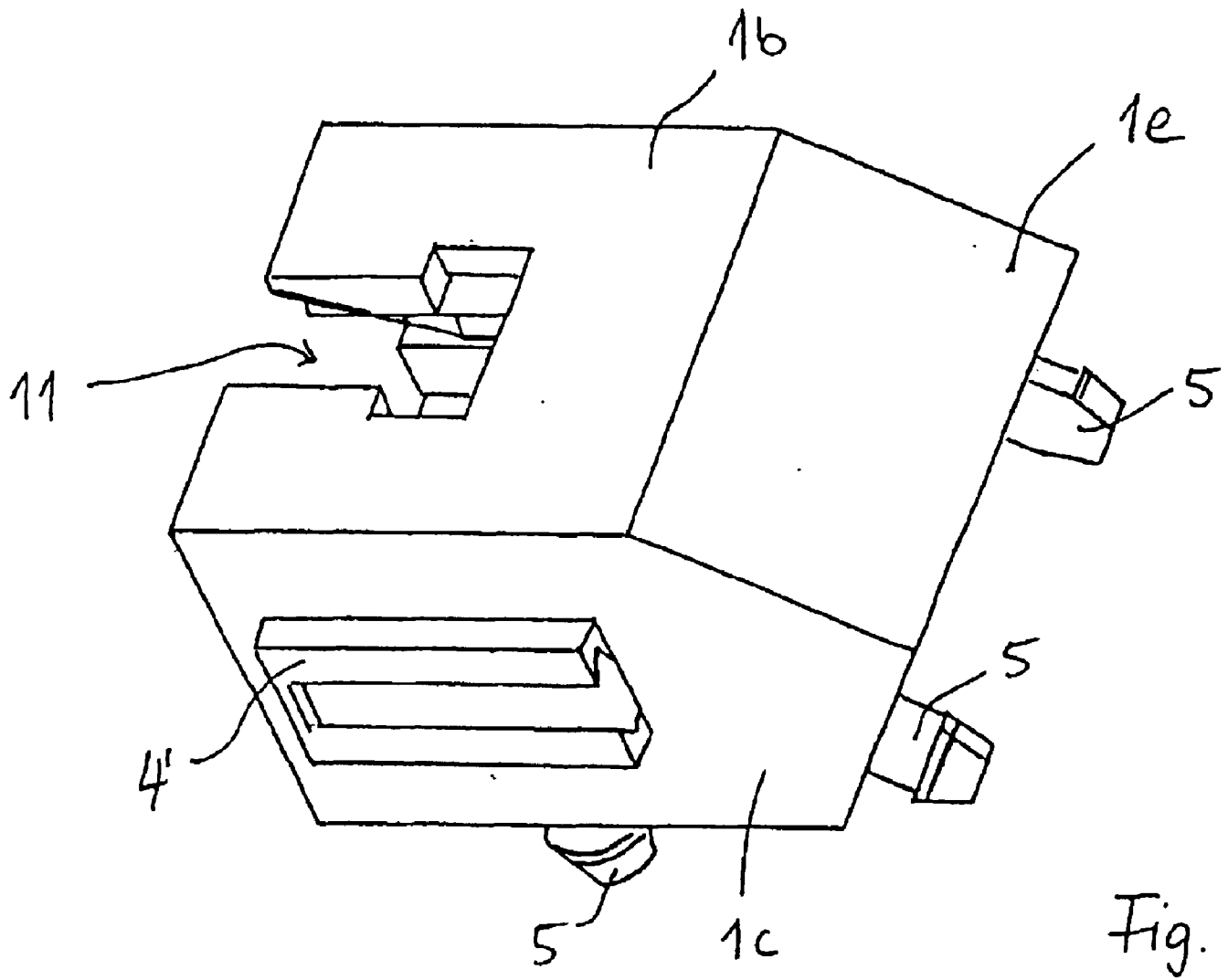
Figure 3:
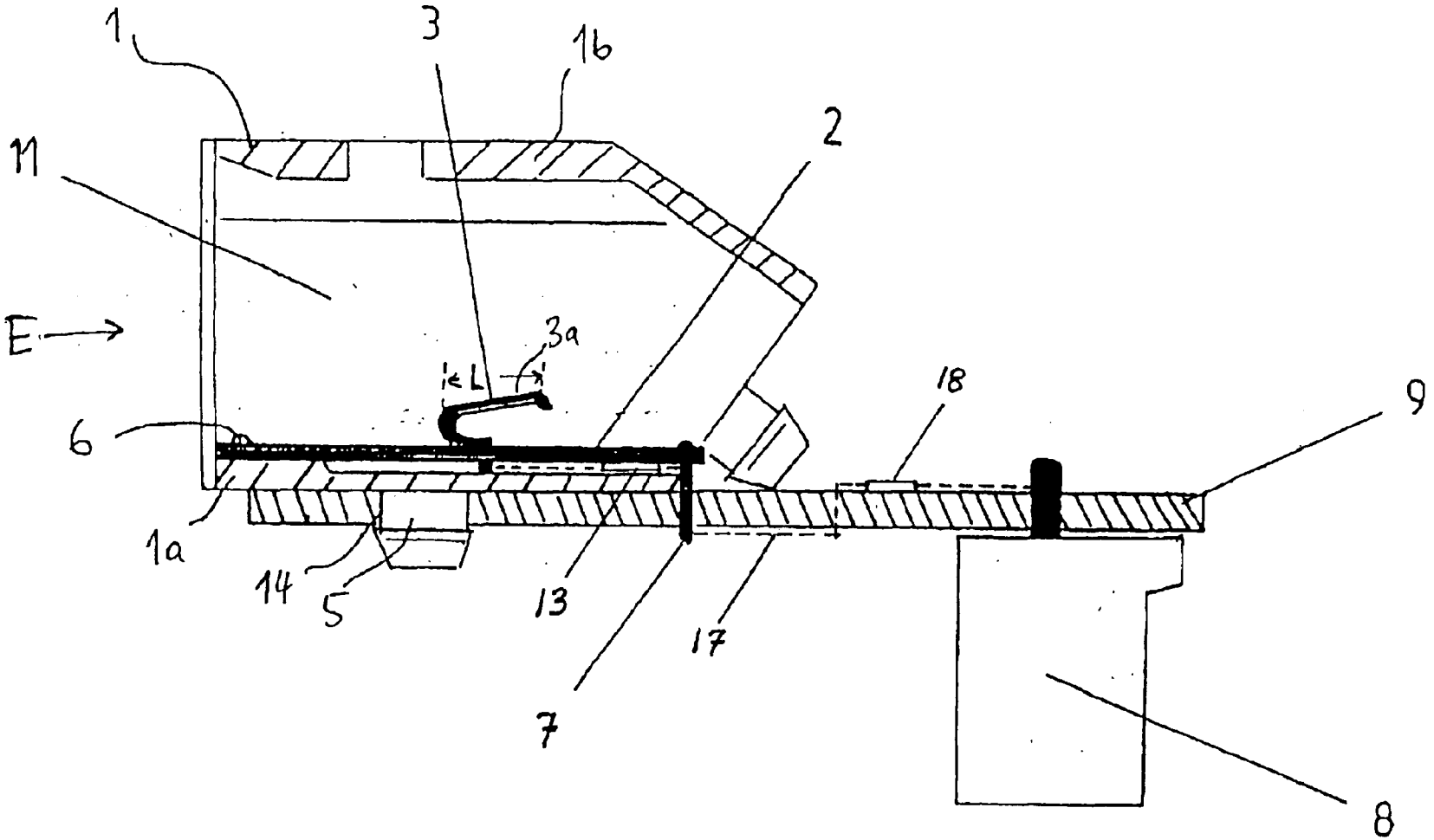
FIGS. 3 and 4 show a section through a connecting socket according to the invention with a female connector in two different installation positions.
Figure 4:
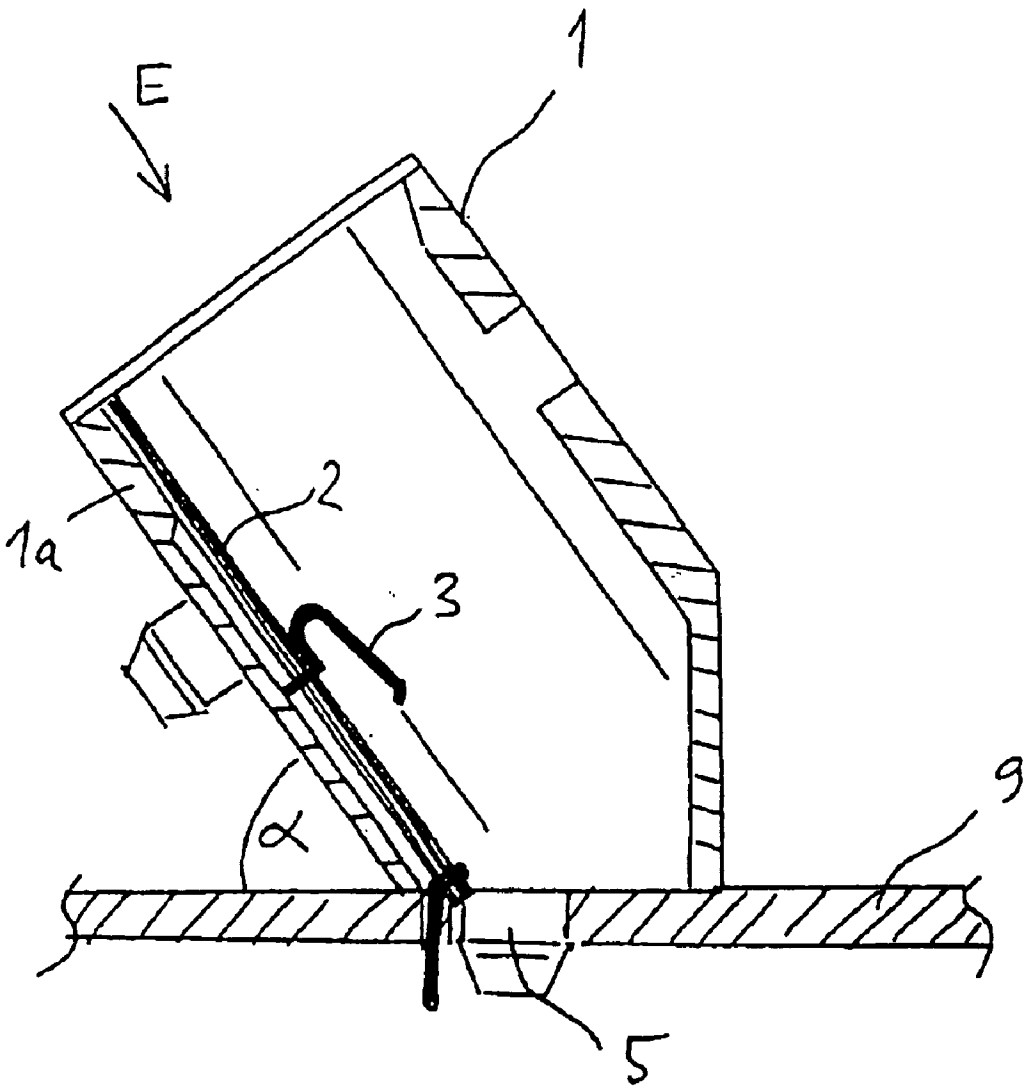

FIGS. 1 and 2 show two three-dimensional views of a female connector according to the invention with a holding element 1 which forms a holder 11 with the same shape as conventional RJ45 female connectors, for a plug. FIGS. 3 and 4 show two different installation positions of this female connector on a base printed circuit board 9.

The holding element 1 has an essentially cuboid basic shape with a bottom surface 1*a* and top surface 1*b*, and two parallel side surfaces 1*c*, 1*d*. The rearward area 1*e* in the present case is inclined or designed in a prism shape, in order to make it possible to mount the connecting element on a base printed circuit board in various installation positions (FIGS. 3 and 4).

The compensation printed circuit board 2 according to the invention is arranged within the holding element 1, in this case in the area of the bottom surface 1*a*. The compensation printed circuit board 2 can, where appropriate, replace the bottom surface 1*a*. Sprung contact elements 3 which are bent in a hook shape are located on the compensation printed circuit board 2, and their contact surfaces 3*a* project into the holder 11 and are oriented such that they point obliquely to the rear and away from the insertion opening for the plug. As is shown in FIG. 3, the length L of the contact elements 3 is only a fraction (in this case approximately one quarter) of the length of the female connector measured in the insertion direction E, while the contact elements according to the prior art generally extend over the entire length of the female connector.

Figure 6A:
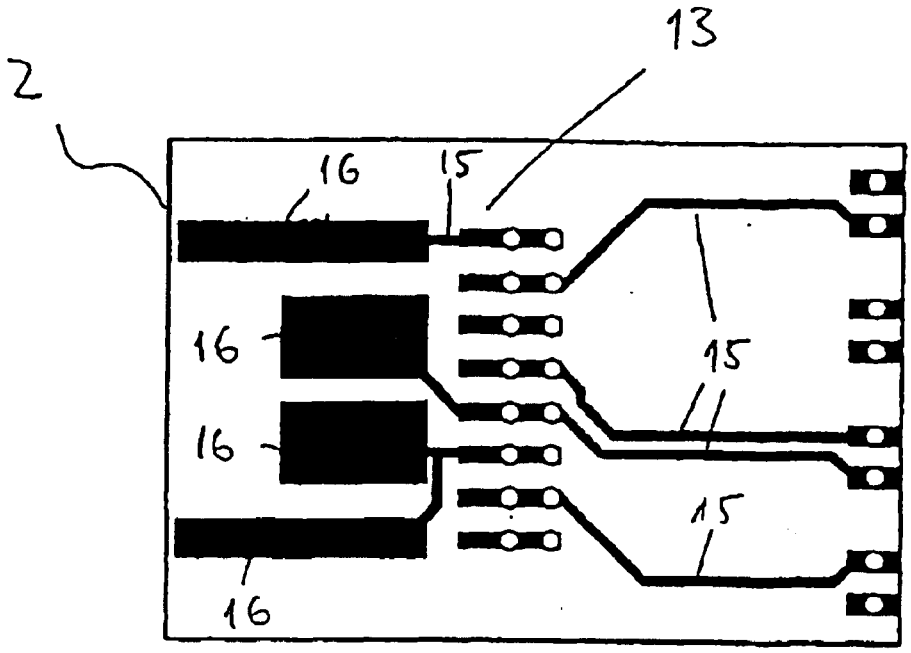
FIGS. 6*a* and 6*b* show an example of a compensation circuit.
Figure 6B:
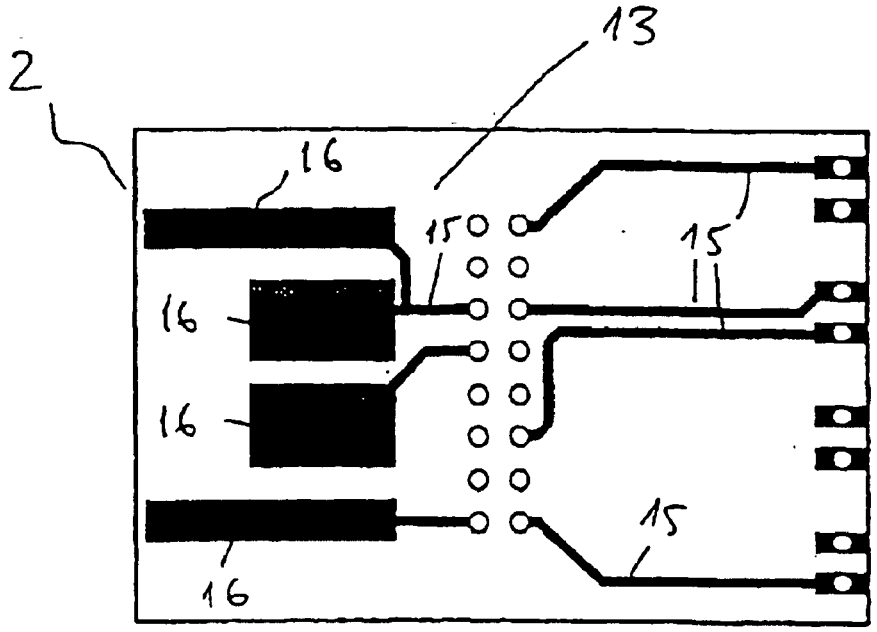

A compensation circuit 13 is also located on the compensation printed circuit board 2, although it is only schematically indicated in FIG. 3. FIGS. 6*a*, and 6*b* as further described below show one example of a compensation circuit 13. The compensation circuit 13 connects the contact elements 3 to connections 7 which in this case are in the form of pins, and by means of which electrical contact is made with the base printed circuit board 9 in the application illustrated in FIGS. 3 and 4. The compensation printed circuit board 2 is guided in two side grooves 10 in the holding element 1 and is fixed by means of a latching connection 6, comprising a cut-out in the compensation printed circuit board 2 and a latching tab in the bottom surface. This ensures that the female connector can be assembled easily. The holding element is preferably integral, in particular an injection molded or die cast part. The female connector may also have additional metallic screening, for example surrounding the holding element.

The holding element 1 has mounting elements 5 in the form of latching tabs or feet, which are used for mounting in corresponding cut-outs 14 in the base printed circuit board 9. The mounting elements 5 are arranged in different orientations with respect to the bottom surface 1*a*, so that the female connector can be installed in different positions. This allows the insertion direction E of the plug to be matched to the requirements on the installation side, for example parallel (FIG. 3) or at an angle $\alpha$ (FIG. 4) to the bottom surface 1*a*, which is generally aligned parallel to the wall that holds the connecting socket.

A connecting strip 8, for example also in the form of a connecting block, is connected to the base printed circuit board 9 and, in this application, is used for permanent connection of lines of a data cable, which is generally laid such that it is stationary. The electrical contact with the corresponding contact element 3 within the female connector is made via line connections 17 on the base printed circuit board 9 and via the connections 7. The base printed circuit board 9 may also have a further compensation circuit 18 in order to compensate, for example capacitively, for crosstalk that occurs outside the female connector.

Figure 5:
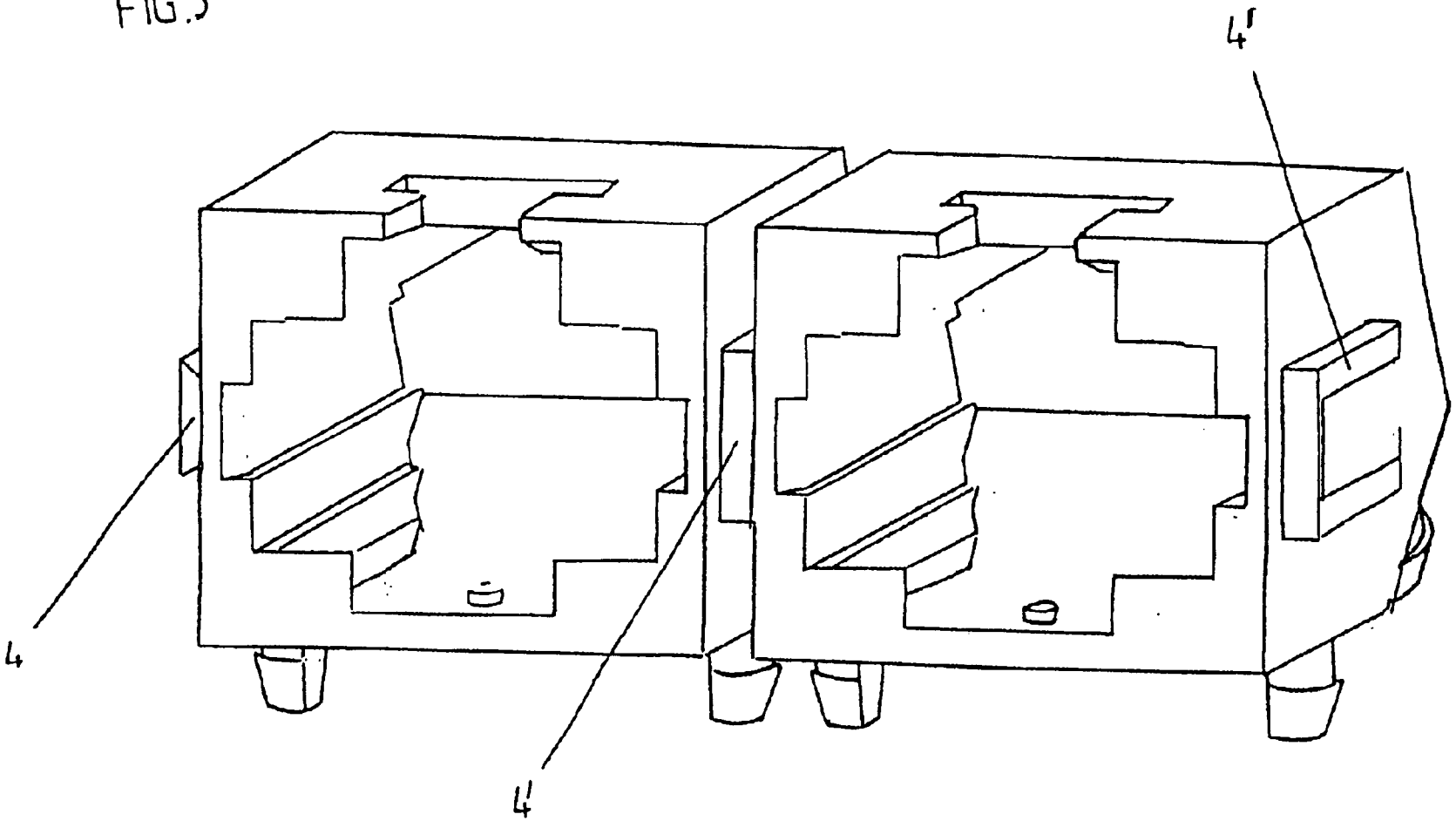
FIG. 5 shows two female connectors coupled to one another.

At the side, the holding element 1 has coupling elements 4, 4' which are matched to one another, in this case in the form of an undercut rail or a dovetail-shaped attachment, which is used for coupling two or more female connectors to one another. FIG. 5 shows one example of a female connector arrangement such as this.

Standard elements, for example a double-sided FR4 printed circuit board, may be used for the compensation printed circuit board and for the base printed circuit board.

FIGS. 6*a* and 6*b* show in detail one example of a compensation circuit 13. The illustrations show the upper face and lower face of the compensation printed circuit board 2 with the respective electronic components, in this case line elements 15 and capacitors 16. In the present case, one decoupling capacitor 16 is in each case located between the line elements, which are associated with the pin pairs 1/3, 3/5, 4/6 and 6/8. Typical values for these capacitances are, for example, 0.81 pF for the pairs 1/3 and 6/8, and 0.92 pF for the pairs 3/5 and 4/6 (at 250 MHz in each case). Considerably higher capacitances and/or more complex circuits are used for the previously known compensation circuits on the printed circuit board, for example a decoupling circuit with the following capacitances between the stated pin pairs: pair 6/4: 2.1 pF; pair 5/3: 2.14 pF; pair 6/8: 1.84 pF; pair 3/8: 1.4 pF; pair 1/3: 0.58 pF.

The dimensions of the compensation printed circuit board 2 are matched to the size of the female connector, and in the present case they are about 17 mm long and 12 mm wide.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A data line connection comprising a base printed circuit board which mounts a connecting strip having contact elements which are connected to lines of a data cable, a female connector mounted to the base printed circuit board and being configured to receive a male connector of a data cable therein, a compensation printed circuit board mounted within said female connector, said compensation printed circuit board mounting a plurality of electrically conductive contact elements which make contact with lines of the male connector when the male connector is inserted into the female connector, said compensation printed circuit board also mounting a compensation circuit which is connected to the contact elements which are mounted to the compensation printed circuit board for reducing electrical interference, and said base printed circuit board including line elements which provide an electrical connection between the contact elements of the female connector and the contact elements of said connecting strip via said compensation circuit, and further including a further compensation circuit on said base printed circuit board for reducing electrical interference in the line elements.

2. The data line connection of claim 1 wherein the compensation circuit board is located within said female connector so as to be in the immediate physical vicinity of the male connector when the male connector is inserted into the female connector.

3. The data line connection of claim 1 wherein the female connector comprises a bottom surface, a top surface, and two opposite sides which form a holder for the male connector, with the compensation printed circuit board being arranged parallel to and adjacent the bottom surface of the female connector.

4. The data line connection of claim 3 wherein the female connector includes grooves on the inside of the opposite sides for mounting said compensation printed circuit board within the female connector.

5. The data line connection of claim 1 wherein the female connector is mounted to said base printed circuit board by means of one of at least two mounting elements on said female connector and which can be selectively received in an opening in said base printed circuit board such that the female connector can be selectively mounted in one of two angular orientations on the base printed circuit board.

6. The data line connection of claim 1 wherein the contact elements of the compensation printed circuit board in the female connector are arcuately curved so as to define a contact surface which is oriented at an acute angle with respect to the compensation printed circuit board.

7. The data line connection of claim 1 wherein the contact surfaces of the contact elements have a length between about 3 and about 8 mm.

8. The data line connection of claim 1 wherein the female connector includes two opposite sides, and wherein at least one coupling is arranged on the outside of each of the opposite sides by means of which at least two female connectors may be joined in a side by side arrangement.

9. The data line connection of claim 1 wherein the female connector is mounted to the base printed circuit board such that the male connector can be inserted into the female connector in a direction parallel to the base printed circuit board or at a predetermined angle with respect thereto.

* * * * *